US005331381A

United States Patent [19]

Ota et al.

[11] Patent Number: 5,331,381

[45] Date of Patent: Jul. 19, 1994

[54] IMAGE FORMING APPARATUS HAVING A TONER REPLENISHING CONTAINER

[75] Inventors: Hiroshi Ota, Tokyo; Tomokazu Nakamura, Yokohama, both of Japan

[73] Assignee: Canon Kabushiki Kaisha, Tokyo, Japan

[21] Appl. No.: 65,909

[22] Filed: May 25, 1993

[30] Foreign Application Priority Data

Jun. 19, 1992 [JP] Japan ..... 4-161089
Dec. 21, 1992 [JP] Japan ..... 4-340516

[51] Int. Cl.[5] ..... G03G 15/06
[52] U.S. Cl. ..... 355/260; 118/657
[58] Field of Search ..... 355/260, 253, 259, 245; 118/657, 658

[56] References Cited

U.S. PATENT DOCUMENTS 4,583,842 4/1986 Shimono et al. .
4,803,513 2/1989 Nishise et al. .
4,931,837 6/1990 Abuyama et al. ..... 355/260 X
4,937,625 6/1990 Kato et al. ..... 355/260 X
4,998,140 3/1991 Satou et al. ..... 355/253 X
5,175,587 12/1992 Kato et al. ..... 355/260

*Primary Examiner*—R. L. Moses
*Attorney, Agent, or Firm*—Fitzpatrick, Cella, Harper & Scinto

[57] ABSTRACT

A replenishing device for replenishing toner to a developing device for developing electrostatic latent images includes a hopper, and a toner conveying screw disposed in the hopper along a bottom surface of the hopper. The bottom surface consists of an inclined surface that rises in a downstream direction relative to the direction in which the screw conveys toner, so that an interior height dimension of the hopper at an end portion that is located upstream in the toner conveyance direction is greater than an interior height dimension at an end portion that is located downstream in the toner conveyance direction.

17 Claims, 10 Drawing Sheets

IMAGE FORMING APPARATUS HAVING A TONER REPLENISHING CONTAINER

BACKGROUND OF THE INVENTION

1. Field of the Invention

The present invention relates to an image forming apparatus in which an electrostatic latent image is formed and developed into a toner image.

2. Related Background Art

In an image forming apparatus of the above-described type, since a developing device for developing electrostatic latent images consumes toner each time the developing device develops an electrostatic latent image, toner is replenished to the developing device as needed.

A toner replenishing device for replenishing toner to the developing device mainly comprises a container (also referred to as "hopper") for containing toner, and a toner conveying member, such as a screw, for conveying toner within the container to a toner outlet port of the container.

A known image forming apparatus of the type being described includes a toner container longer in a horizontal direction than in the vertical direction, and disposed in the body of the apparatus at a position immediately behind a front cover of the body with the longitudinal dimension of the container lying parallel with the front cover in its closed position.

In such an image forming apparatus, if the toner container is made longer in order to increase its capacity, the increase in the length of the container creates disadvantages. For example, one of the ends of the container may become closer to a heat fusing device of the apparatus, thereby increasing the risk that toner particles may aggregate within the container. In addition, the distribution of the internal space of the apparatus among various structures to be disposed therein may become difficult.

Increasing the height of the toner container over the full length of the container may also make it difficult to distribute the internal space of the apparatus among various structures, and sometimes necessitates an increase in the size of the apparatus.

SUMMARY OF THE INVENTION

An object of the present invention is to provide an image forming apparatus including a toner container having an increased storage capacity without involving a substantial increase in the longitudinal dimension thereof.

Another object of the present invention is to provide an image forming apparatus of small size yet having a toner container of a relatively large capacity.

In one aspect, the present invention relates to an image forming apparatus comprising a developing device for developing an electrostatic latent image formed on an image carrying member, to form a toner image, and a toner replenishing device for replenishing toner to the developing device. The toner replenishing device comprises a container for toner, the container having a toner inlet opening, a cover member operable to open and close the toner inlet opening, and a toner outlet opening through which toner stored in the container is replenished to the developing device. The container is longer in a horizontal direction than in a vertical direction, and the toner outlet opening is provided at a first longitudinal end portion of the container. A toner conveying member is disposed longitudinally in the container, the toner conveying member being rotatable about an axis of rotation to convey toner within the container to the toner outlet opening, and a rotatable toner stirring member is juxtaposed with the toner conveying member, wherein a bottom surface of the container is inclined in a downstream direction relative to a direction of toner conveyance by the toner conveying member, wherein the axis of rotation of the toner conveying member is inclined such that the axis of rotation has an upstream end in a direction of toner conveyance, and a downstream end in the direction of toner conveyance that is positioned higher than the upstream end, and wherein an interior height of the container at the second longitudinal end portion is greater than an interior height of the container at the first longitudinal end portion of the container.

In another aspect, the present invention relates to an image forming apparatus comprising a developing device for developing an electrostatic latent image formed on an image carrying member, to form a toner image, and a toner replenishing device for replenishing toner to the developing device. The toner replenishing device comprises a container for toner, the container having a toner inlet opening, a cover member operable to open and close the toner inlet opening, and a toner outlet opening through which toner stored in the container is replenished to the developing device. The container is longer in a horizontal direction than in a vertical direction, and the toner outlet opening is provided at a first longitudinal end portion of the container, wherein a bottom surface of the container is inclined such that the bottom surface at the first longitudinal end portion of the container is higher than the bottom surface at the second longitudinal end portion of the container, and wherein an interior height of the container at the second longitudinal end portion is greater than an interior height at the first longitudinal end portion of the container. A toner conveying member is disposed in the container and extends along the inclined bottom surface of the container. The toner conveying member is rotatable about an axis of rotation to convey toner within the container in a toner conveyance direction to the toner outlet opening, wherein the axis of rotation of the toner conveying member is inclined such that the axis of rotation has an upstream end in a direction of toner conveyance, and a downstream end in the direction of toner conveyance that is positioned higher than the upstream end. A rotatable toner stirring member is juxtaposed with the toner conveying member, and a wall member is disposed in the container adjacent the toner conveying member and is disposed between the toner conveying member and the toner stirring member, the wall member dividing the interior of the container into a first section, in which the toner conveying member is disposed, and a second section, in which the toner stirring member is disposed, wherein the first section has an upper portion that is open to the second section such that toner within the container can move from the second section into the first section. Support structure is provided for supporting the container such that the container is pivotable on a substantially horizontal plane about an axis passing through the first longitudinal end portion of the container, wherein the container pivots between a first position, where the container is disposed inside a body of the apparatus, and a second position, where the container is disposed substantially outside the body, and wherein the container is arranged for receiving a toner supplement through the toner inlet opening when the container is in the second position.

The above and other objects and features of the present invention will become apparent from the following description of the preferred embodiments and the accompanying drawings, wherein like reference numerals correspond to like or similar elements throughout the drawings.

DETAILED DESCRIPTION OF THE PREFERRED EMBODIMENTS

Figure 1:
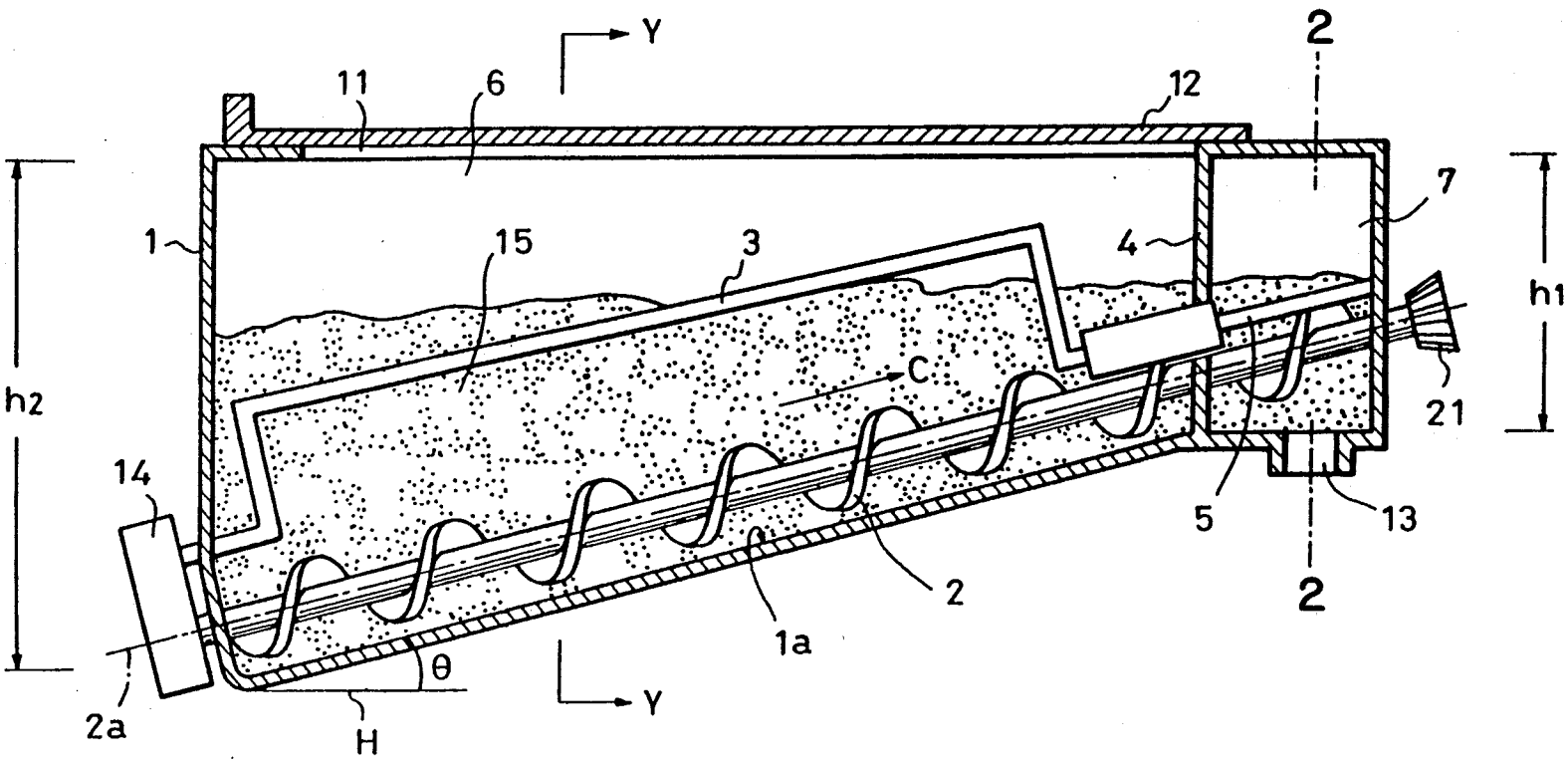
FIG. 1 is a longitudinal sectional view of the essential parts of an embodiment of the present invention.

Referring to FIG. 1, an image forming apparatus, such as an electrophotographic apparatus, according to an embodiment of the present invention includes a device for replenishing toner to a developing device of the apparatus. The toner replenishing device includes a toner container 1 (hereinafter referred to as a "hopper") that is longer in a horizontal direction than in the vertical direction. A toner inlet opening 11, through which toner can be poured into the hopper 1, is formed in an upper portion of the hopper 1. The opening 11 is normally closed by a cover 12. When toner is to be supplemented to the replenishing device, the operator moves the cover 12 horizontally along a guide, not shown, to open the opening 11. Then, a known toner supplement cartridge is fitted on the edge of the opening 11 to charge toner from the cartridge into the hopper 1. When toner has thus been supplemented, the operator removes the cartridge from the hopper 1, and closes the opening 11 with cover 12.

The inside of the hopper 1 has a bottom surface 1*a* inclined along the longitudinal direction of the hopper 1 at an angle $\theta$ with respect to a horizontal reference plane H. Specifically, the bottom surface 1*a* is gradually inclined in a downstream direction relative to a direction of toner conveyance as described later. A toner outlet opening 13 is formed at the upper level of the inclined bottom surface 1*a*. In other words, the toner outlet opening 13 is formed at a first longitudinal end portion (right end portion, as viewed in FIG. 1) of the hopper 1.

Since the bottom surface 1*a* of the inside of the hopper 1 is inclined such that the bottom surface 1*a* is higher at the first longitudinal end portion of the hopper 1 than at the second longitudinal end portion of the hopper 1, a height dimension $h_2$ of the inside of the hopper 1 at the second longitudinal end portion of the hopper 1 is greater than a height dimension $h_1$ at the first longitudinal end portion. Thus, the capacity of the hopper 1 can be increased without increasing the longitudinal dimension of the hopper 1. Since the height dimension is gradually increased over the entire length of the hopper 1, the size of the entire apparatus need not be increased.

The toner replenishing device also includes a toner conveying screw 2 disposed in the hopper 1 and extending along the hopper bottom surface la. The screw 2 is in proximity to the inclined bottom surface 1*a*. The screw 2 is preferably disposed substantially parallel with the inclined bottom surface 1*a* because, with this arrangement, toner 15 within the hopper 1 can be smoothly moved upward along the inclined bottom surface 1*a*.

The screw 2 has an axis of rotation 2*a* inclined with respect to the horizontal plane H such that the end of the axis 2*a* located in a downstream direction relative to the direction in which toner is conveyed (i.e., the toner conveyance direction), that is, the end corresponding to the first longitudinal end portion of the hopper 1, is higher than the end located in an upstream direction relative to the direction of toner conveyance, that is, the end corresponding to the second longitudinal end portion of the hopper 1. The axis of rotation 2*a* of the screw 2 is preferably substantially parallel with the inclined bottom surface 1*a* of the hopper 1. The screw 2 has a gear 21, to which a drive force of a motor, not shown, is transmitted. When the screw 2 is thus driven, the screw 2 rotates in the direction indicated by arrow A in FIG. 2 to convey toner 15 within the hopper 1 in the direction indicated by arrow C in FIG. 1 along the inclined bottom surface 1*a* (which rises in this direction) to a position corresponding to the toner outlet opening 13.

Figure 3:
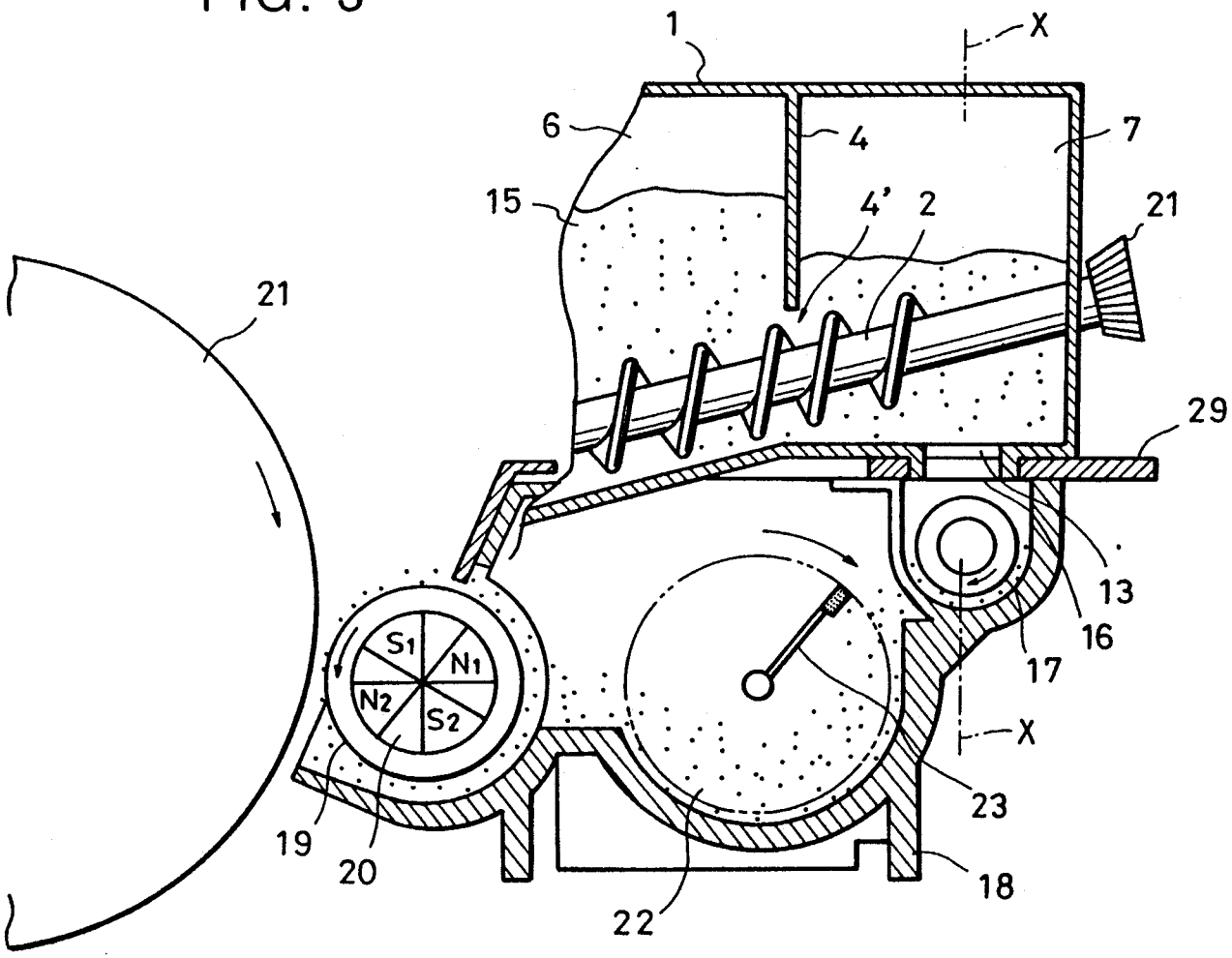
FIG. 3 is a sectional view of a developing device and a replenishing device of an embodiment of the present invention, the replenishing device being shown in an enlarged fragmentary sectional view.

The toner outlet opening 13 is located in a chamber 7 separated by a partition 4 from another chamber 6 into which toner can be charged from a cartridge. As shown in FIG. 3, the partition 4 has a bore 4' through which one end portion of the screw 2 is passed, and through which toner can move from the chamber 6 to the chamber 7.

Figure 2:
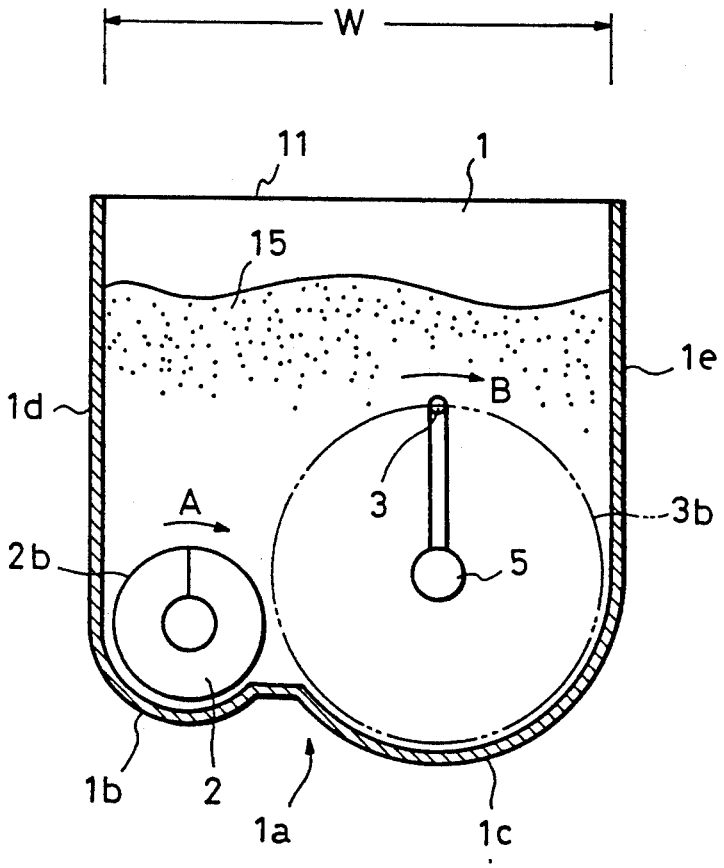
FIG. 2 is a cross-sectional view taken along line 2—2 shown in FIG. 1.

Referring now to FIG. 2, the toner replenishing device further includes a crank-shaped toner stirring rod 3 disposed in the hopper 1 in juxtaposition with the screw 2. As shown therein, the toner stirring rod 3 is mounted to a rotary shaft 5, and is capable of rotating in a direction indicated by arrow B in FIG. 2. The toner stirring rod 3 has an axis of rotation disposed substantially parallel with the inclined bottom surface 1*a* of the hopper 1, and a locus of rotation 3*b* (indicated by a two-dot-chain line in FIG. 2) positioned in proximity to a region 1*c* of the bottom surface 1*a*. The toner stirring rod 3 stirs particles of toner 15 within the hopper 1 so as to break apart any toner blocks or agglomeration, and to cause a portion of toner 15 in an area of the bottom surface 1*a* which is not covered by the screw 2 to move toward the screw 2.

The screw 2 and the rotary shaft 5 of the stirring rod 3 are interconnected by a gear train 14 so that the screw 2 and the rod 3 are rotatable in unison. Alternatively, the drive force of the motor may be directly transmitted to the rotary shaft 5.

As shown in FIG. 2, a region 1*b* and the region 1*c* of the hopper bottom surface 1*a*, which respectively correspond to a locus of rotation 2*b* (indicated by a solid line in FIG. 2) of the screw 2 and the locus of rotation 3*b* of the stirring rod 3, have circular-arc contours substantially concentric with the center of rotation of the screw 2 and the center of rotation of the stirring rod 3, respectively, so as to minimize a dead space in the hopper 1.

The hopper 1 has a pair of longitudinally-extending side walls 1*d* and 1*e* which are substantially parallel with each other at least within a longitudinal region inside the hopper 1 where the screw 2 and the stirring rod 3 extend. Thus, the inside of the hopper 1 has a widthwise dimension W (shown in FIG. 2) which is substantially constant throughout the longitudinal direction of the hopper 1. However, the widthwise dimension may be varied along the longitudinal direction of the hopper 1. For instance, the widthwise dimension may be relatively great at one longitudinal end of the hopper 1 while it is relatively small at the other longitudinal end. Regardless of whether the widthwise dimension W is constant or not, the inclination of the hopper bottom surface 1*a*, which rises in a downstream direction relative to the direction of toner conveyance, permits the interior of the hopper 1 to have a cross-sectional area perpendicular to the longitudinal direction of the hopper 1 which increases in an upstream direction relative to the toner conveyance direction. As a result, the hopper 1 has a greater capacity than a hopper having a horizontal bottom surface level with and extending from the outlet opening 13.

In order to assure that toner (particles) 15 will be smoothly conveyed, the angle of inclination $\theta$ of the hopper bottom surface 1*a* with respect to the horizontal plane H is preferably 5 to 20 degrees.

Referring to FIG. 3, the developing device to which toner 15 is replenished by the replenishing device includes a rotatable developing sleeve 19 for carrying toner thereon to convey toner to a rotatable electrophotographic photosensitive member 21, a magnet 20 disposed inside the sleeve 19, and a storage chamber 22 for temporarily storing toner to be supplied to the sleeve 19. A rotatable stirring rod 23 is disposed in the storage chamber 22 to supply toner stored in the chamber 22 to the sleeve 19.

The image forming apparatus has a conventional latent image forming device, not shown, which forms an electrostatic latent image on the photo-sensitive member 21. The electrostatic latent image is developed with toner supplied from the sleeve 19 so that a toner image is formed on the photo-sensitive member 21. The toner image is transferred to paper by a conventional transfer device, not shown, of the apparatus. The toner image transferred to paper is heat-fused on the paper by a conventional heat fusing device 25 (generally shown in FIG. 4) of the apparatus.

Referring to FIG. 3, the toner outlet opening 13 of the hopper 1 is connected to one longitudinal end portion of the developing device 18 whose longitudinal direction lies along the axis of rotation of the sleeve 19. The developing device 18 has a screw 17 for conveying toner discharged from the outlet opening 13 to the storage chamber 22. The screw 17 is supplied with toner which has passed through an inlet opening 16 of the developing device 18 communicating with the outlet opening 13 of the hopper 1, and which has fallen under its own weight onto the screw 17.

The developing device 18 is provided with a conventional sensor for detecting the amount of toner within the storage chamber 22. When the amount of toner within the storage chamber 22 decreases below a prescribed amount, the screw 2 in the hopper 1 is driven and rotated so that toner is replenished from the replenishing device to the developing device 18 through the outlet opening 13 and the inlet opening 16.

Figure 4:
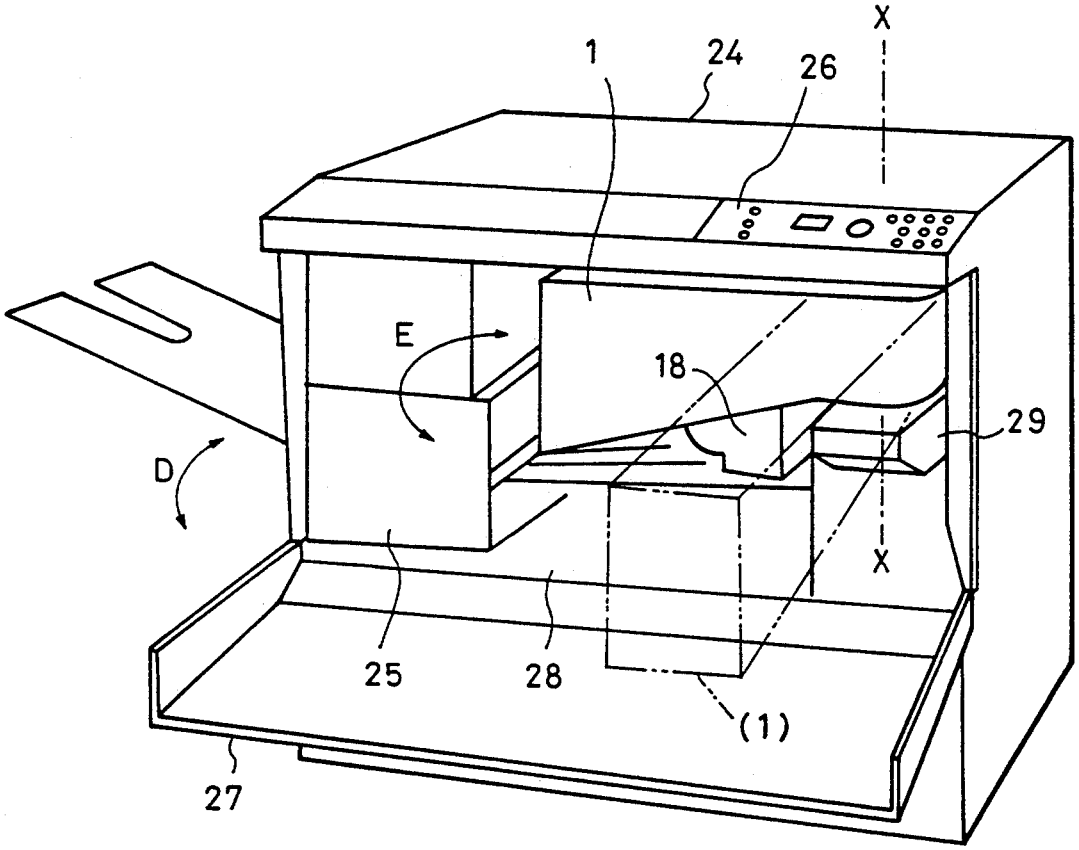
FIG. 4 is a perspective view of an embodiment of the present invention, showing the external appearance thereof.

Referring now to FIG. 4, a support 29 of the image forming apparatus supports the hopper 1 such that the hopper is able to turn or pivot on a plane that is substantially horizontal relative to the developing device 18 about a substantially vertical axis X at the first longitudinal end portion of the hopper 1. If the axis X passes through the respective centers of the toner outlet opening 13 and the inlet opening 16, the outlet opening 13 and the inlet opening 16 can remain aligned with each other even when the hopper 1 is turning. In this case, therefore, it is not necessary to specially provide a shutter or the like between the outlet opening 13 and the inlet opening 16. The hopper 1 is pivotable in the directions indicated by arrows E in FIG. 4.

Referring again to FIG. 4, the apparatus has a body 24 which accommodates the photo-sensitive member 21, the developing device 18, the heat-fusing device 25 and other devices and equipment, all necessary to image formation.

A control section 26 is provided on the upper portion of the body 24 at a forward location thereof. The control section 26 includes various switches, such as a copy key, a copy number setting key and a density adjusting key, arranged therein so that the operator can select a desired image forming operation using the switches.

A swing door 27 is provided on the front side of the body 24, and is supported by the body 24 (e.g., by hinges) such that the door 27 is capable of swinging in the directions indicated by arrow D in FIG. 4. When the door 27 swings to the illustrated position, thereby opening a front opening 28 of the body 24, the hopper 1 is accessible to the operator. Thus, in the operable position, the hopper 1 is positioned inside the body 24 immediately behind the door 27 with the longitudinal direction of the hopper 1 lying substantially parallel with the surface of the door 27 when the door 27 is closed. That is, when an image forming operation of the apparatus is possible. When the hopper 1 is at the forward position inside the body 24 (first position of the hopper, indicated by solid lines in FIG. 4), toner is replenished from the replenishing device to the developing device 18 as needed, as described before. In the first position, the longitudinal direction of the hopper 1 lies substantially perpendicular to the longitudinal direction of the developing device 18, that is, to the axis of rotation of the sleeve 19. In this position, the other longitudinal end portion of the hopper 1, that is, the end portion longitudinally opposite to the axis X, is positioned near the heat fusing device 25.

When toner is to be supplemented to the hopper 1, the door 27 is swung open to the above-described position, and the hopper 1 is manually turned by the operator horizontally about the axis X to a position located substantially outside the body 24 (second position of the hopper 1, indicated by two-dot-chain lines in FIG. 4). In this position, toner is supplemented from a cartridge into the hopper 1 in the manner described above. When toner supplementation has been completed, the hopper 1 is manually returned to the first position, and the door 27 is closed. The door 27 may have a construction other than that illustrated in FIG. 4. For example, the door 27 may comprise a two-panel door.

Figure 5:
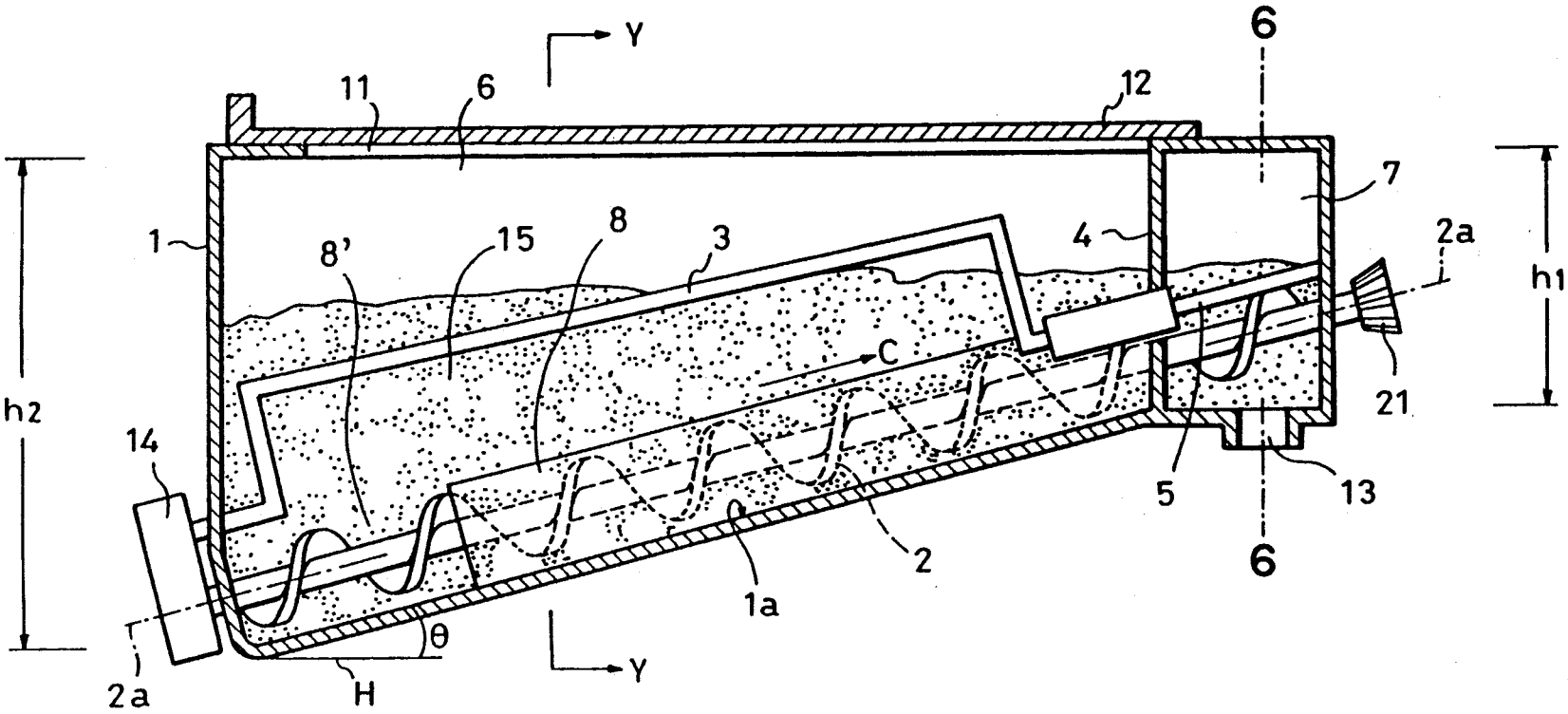
FIG. 5 is a longitudinal sectional view of the essential parts of another embodiment of the present invention.
Figure 6:
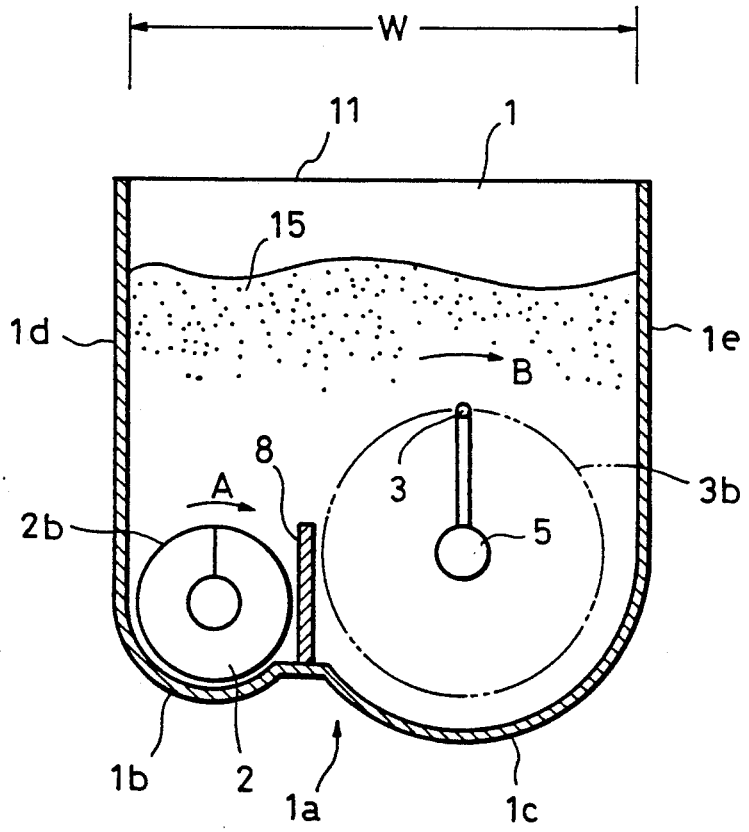
FIG. 6 is a cross-sectional view taken along line 6—6 shown in FIG. 5.

In another embodiment of the present invention, as shown in FIGS. 5 and 6, a plate-shaped partition wall 8 is provided in the hopper 1 at a position adjacent the screw 2 and between the stirring rod 3 and the screw 2. The partition wall 8 projects from the bottom surface 1*a* and extends in the direction in which toner is conveyed by the screw 2.

The partition wall 8 divides the inside of the hopper 1 into a first section in which the screw 2 is disposed and a second section in which the stirring rod 3 is disposed. As shown in FIG. 6, an upper portion of the first section is not enclosed by the partition wall 8 but is open to the second section so that toner 15 stored in the second section can move into the first section.

Figure 7:
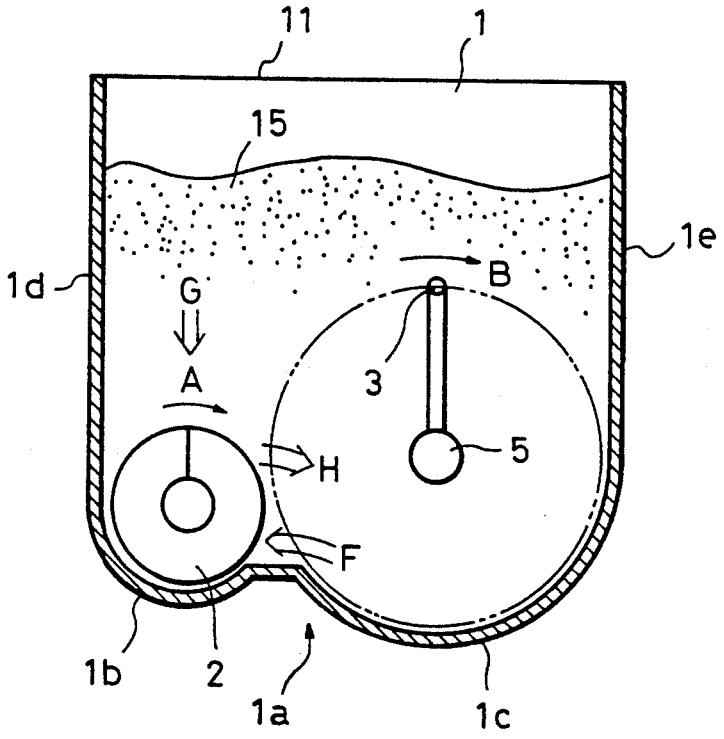
FIG. 7 is a view for illustrating toner supply to and toner leakage from a screw.

The partition wall 8 is provided for the following reasons:

The amount of toner discharged from the outlet opening 13 is substantially proportional to an amount expressed as: [{the amount of toner (F) supplied to the screw 2 by the operation of the stirring rod 3}+{the amount of toner (G) supplied to the screw 2 from above the screw 2 by the force of gravity}−{the amount of toner (H) leaking from the screw 2 }] (see FIG. 7) .

The amount of toner (F) supplied to the screw 2 by the operation of the stirring rod 3 is substantially constant regardless of whether the partition wall 8 is provided or not.

On the other hand, the amount of toner (H) forced to one side of the screw 2 by the rotation of the screw 2 is greater when the partition wall 8 is not provided than when it is provided. Such a side leakage from the screw 2 is compensated for by an amount of toner falling from above the screw 2 to the screw 2.

However, since the hopper bottom surface 1*a* is inclined in a downstream direction relative to the toner conveyance direction, as described above, the amount of toner existing above the screw 2 is relatively small at downstream positions in the toner conveyance direction. Therefore, in a process in which portions of the toner 15 within the hopper 1 are subsequently discharged from the outlet opening 13, a toner covering existing above the screw 2 at downstream positions runs out within a relatively short period of time, causing a downstream portion of the screw 2 to be deprived of a toner covering.

In this condition, at these downstream positions, there is no toner supply amount (G) though there is a toner leakage amount (H) . Consequently, the amount of toner discharged from the outlet opening 13 per unit time gradually decreases with the passage of time, as indicated by the curve shown in FIG. 8.

In order to prevent the above problem, the partition wall 8 is provided on one side of the screw 2 with the hopper side wall 1*d* located on the other side of the screw 2 in proximity thereto. Thus, the screw 2 is disposed in a toner conveyance channel that opens upward and is elongated in the toner conveyance direction.

Figure 9:
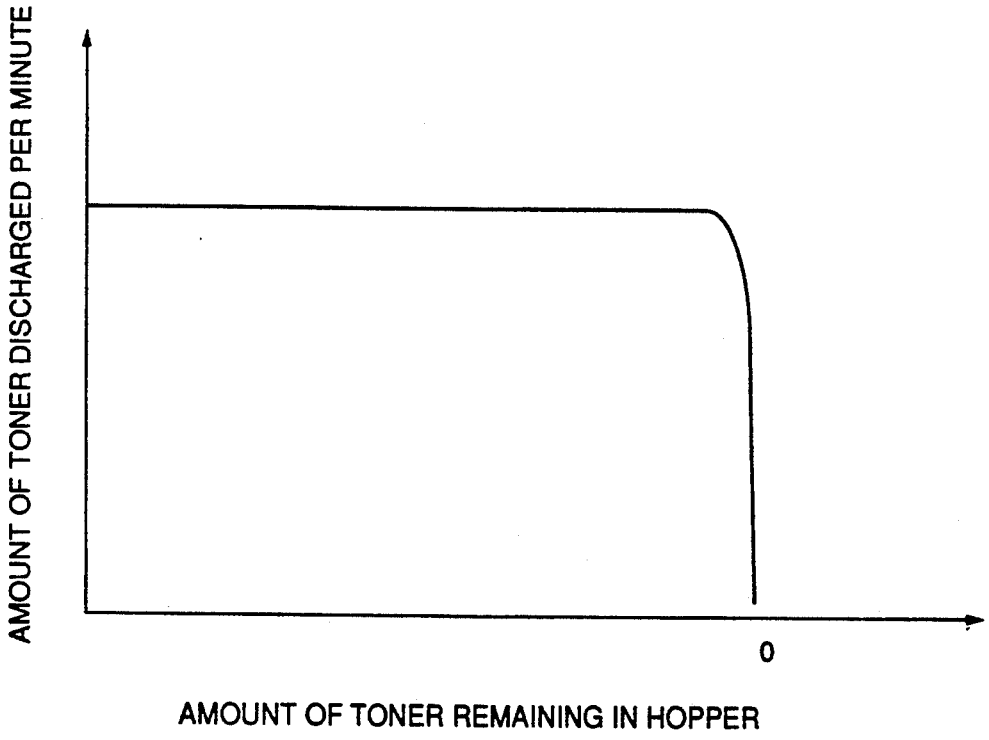
FIG. 9 is a graph for illustrating the speed at which toner is discharged when toner leakage from the screw is prevented.

With this arrangement, it is possible to prevent toner from being forced to leak sideways from the rotating screw 2 and, accordingly, it is possible to maintain a sufficient amount of toner in the space surrounding the screw 2 over the full length of the screw 2. Consequently, the amount of toner discharged from the outlet opening 13 per unit time remains constant for a relatively long period of time, as shown in FIG. 9.

As shown in FIG. 5, the partition wall 8 does not exist in a region 8' adjacent an end portion of the screw 2 and at an upstream portion in the toner conveyance direction. This region 8' constitutes a passage for toner moving from the stirring rod 3 to the screw 2, thereby assuring that a required amount of toner is supplied from the stirring rod 3 to the screw 2.

According to experiments, a toner passage region 8' having a length in the toner conveyance direction ranging from 15 to 30 mm is suitable when the angle $\theta$ of inclination is 10 degrees and the screw pitch is 15 mm.

Figure 10:
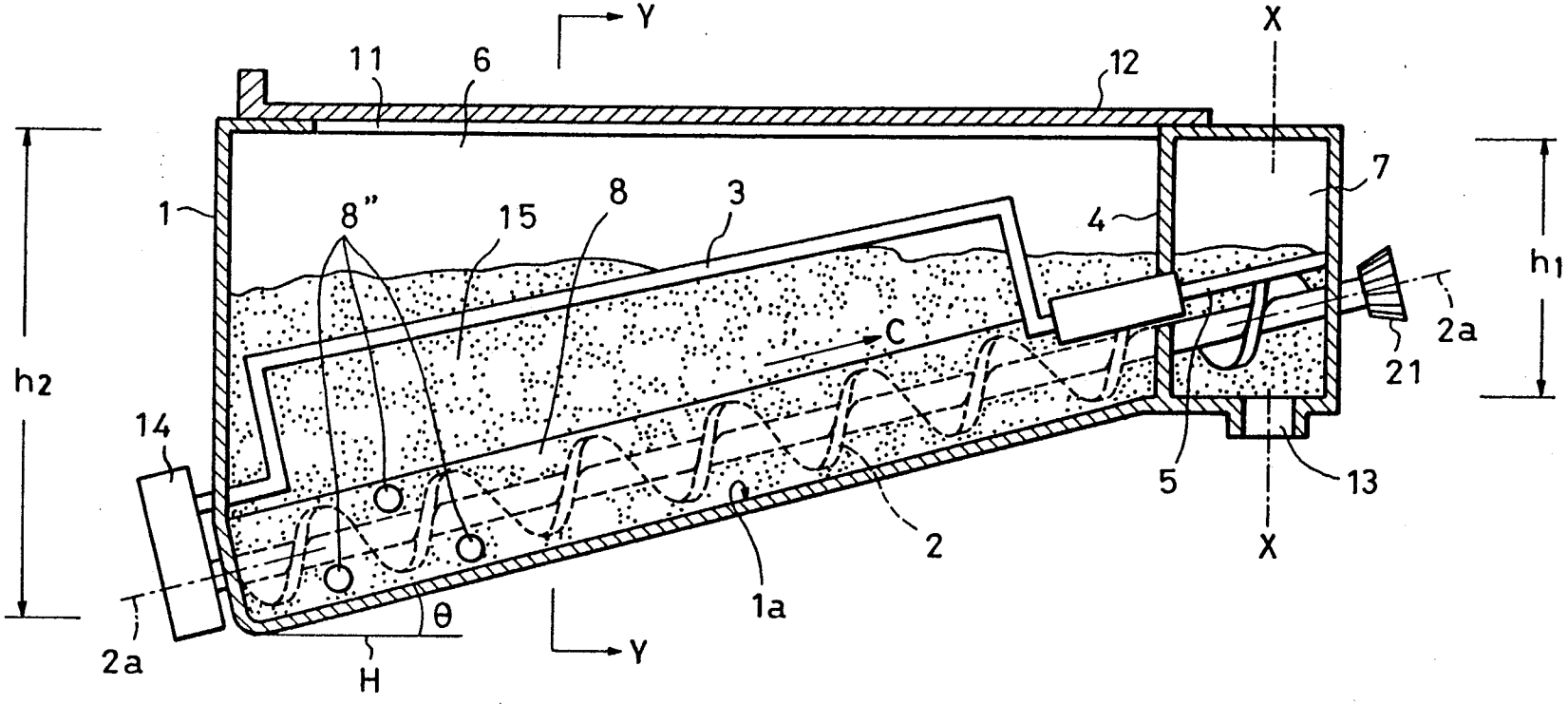
FIG. 10 a longitudinal sectional view of the essential parts of still another embodiment of the present invention.

Referring now to FIG. 10, in another embodiment of the present invention, a partition wall 8 having toner passage openings 8'' may be provided in order to assure a required amount of toner supply from the stirring rod 3 to the screw 2.

Figure 8:
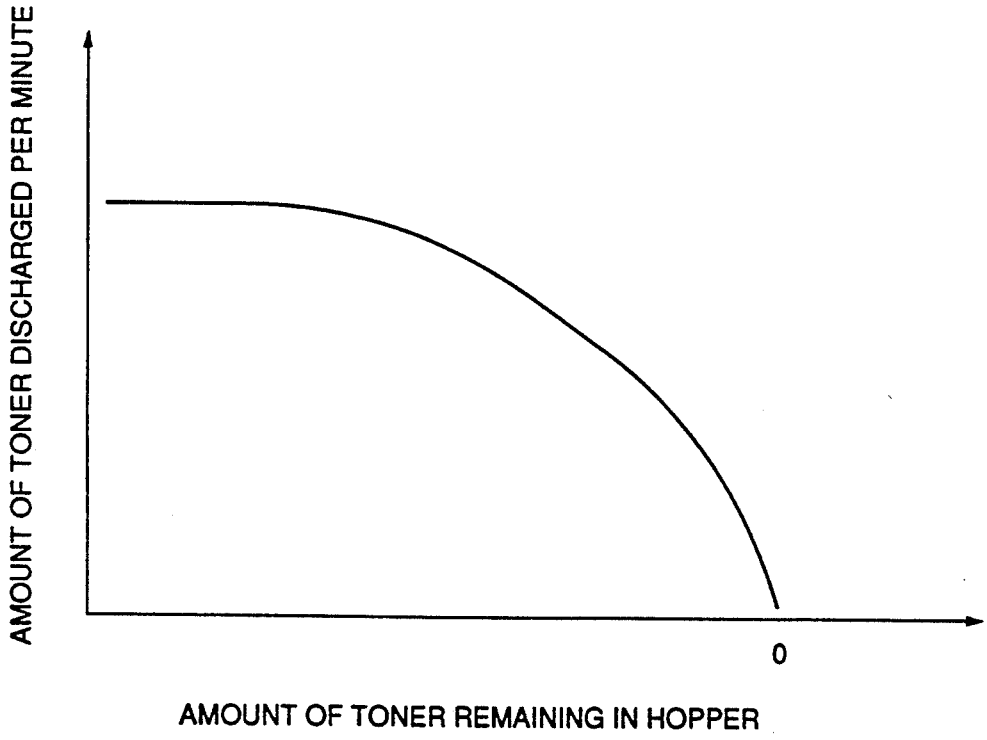
FIG. 8 is a graph for illustrating the speed at which toner is discharged when there is toner leakage from the screw.

Although in the above-described examples, the partition wall 8 comprises a plate-shaped member, as shown in FIGS. 7, 8 and 10, the wall 8 may be in another form so long as it serves to prevent or reduce side leakage of toner 15 from the screw 2. For example, the partition wall 8 may comprise a mesh member, or a member having a bar or a plurality of bars arranged vertically.

As shown in FIG. 6, the locus of rotation 3*b* of the stirring rod 3 has a greater radius than the locus of rotation 2*b* of the screw 2. The partition wall 8 has an upper edge positioned, as shown in FIG. 6, lower than the highest point of the locus of rotation 3*b* of the stirring rod 3. Simultaneously, the upper edge of the partition wall 8 is positioned as high as or higher than the highest point of the locus of rotation 2*b* of the screw 2. This arrangement is advantageous in that, while side leakage of toner 15 from the screw 2 is efficiently prevented, a sufficient amount of toner 15 is supplied by the stirring rod 3 from the second section to above the screw 2.

Although the present invention has been described with respect to several specific embodiments and applications, it is not limited thereto. Numerous variations and modifications readily will be appreciated by those skilled in the art and are intended to be included within the scope of the present invention, which is recited in the following claims.

What is claimed is:

1. An image forming apparatus comprising:

a developing device for developing an electrostatic latent image formed on an image carrying member, to form a toner image; and a toner replenishing device for replenishing toner to said developing device, said toner replenishing device comprising:

a container for containing toner, said container having a toner inlet opening, a cover member operable to open and close the toner inlet opening, and a toner outlet opening through which toner stored in said container is replenished to said developing device, said container being longer in a horizontal direction than in a vertical direction, and said toner outlet opening being provided at a first longitudinal end portion of said container;

a toner conveying member disposed in said container along a longitudinal direction of said container, said toner conveying member being rotatable about an axis of rotation to convey toner within said container to said toner outlet opening; and a rotatable toner stirring member disposed in said container in juxtaposition with said toner conveying member, wherein a bottom surface of said container is inclined in a downstream direction relative to a direction of toner conveyance by said toner conveying member, wherein the axis of rotation of said toner conveying member is inclined such that the axis of rotation has an upstream end in a direction of toner conveyance, and a downstream end in the direction of toner conveyance that is positioned higher than said upstream end, and wherein an interior height of said container at the second longitudinal end portion is greater than an interior height of said container at the first longitudinal end portion of said container.

2. An apparatus according to claim 1, wherein the axis of rotation of said toner conveying member is substantially parallel with the bottom surface of said container.

3. An apparatus according to claim 2, wherein said toner conveying member is a screw.

4. An apparatus according to claim 2, wherein said toner conveying member is a screw.

5. An apparatus according to claim 3, wherein the bottom surface of said container is inclined at an angle in the range of 5 to 20 degrees with respect to a horizontal reference plane.

6. An apparatus according to claim 4, wherein the bottom surface of said container is inclined at an angle in the range of 5 to 20 degrees with respect to a horizontal reference plane.

7. An apparatus according to claim 5, further comprising:

supporting means for supporting said container such that said container is pivotable on a substantially horizontal plane about an axis passing through the first longitudinal end portion of said container, wherein said container pivots between a first position, where the container is disposed inside a body of said apparatus, and a second position, where the container is disposed substantially outside said body, and wherein said container is arranged for receiving therein a toner supplement through said toner inlet opening when said container is disposed in said second position.

8. An apparatus according to claim 6, further comprising:

supporting means for supporting said container such that said container is pivotable on a substantially horizontal plane about an axis passing through the first longitudinal end portion of said container, wherein said container pivots between a first position, where the container is disposed inside a body of said apparatus, and a second position, where the container is disposed substantially outside said body, and wherein said container is arranged for receiving therein a toner supplement through said toner inlet opening when said container is disposed in said second position.

9. An image forming apparatus comprising:

a developing device for developing an electrostatic latent image formed on an image carrying member, to form a toner image;

a toner replenishing device for replenishing toner to said developing device, said toner replenishing device comprising:

a container for containing toner, said container having a toner inlet opening, a cover member operable to open and close the toner inlet opening, and a toner outlet opening through which toner stored in said container is replenished to said developing device, said container being longer in a horizontal direction than in a vertical direction, said toner outlet opening being provided at a first longitudinal end portion of said container, wherein a bottom surface of said container is inclined such that said bottom surface at the first longitudinal end portion of said container is higher than the bottom surface at the second longitudinal end portion of said container, and wherein an interior height of said container at the second longitudinal end portion is greater than an interior height at the first longitudinal end portion of said container;

a toner conveying member disposed in said container and extending along the inclined bottom surface of said container, said toner conveying member being rotatable about an axis of rotation to convey toner within said container in a toner conveyance direction to said toner outlet opening, wherein the axis of rotation of said toner conveying member is inclined such that the axis of rotation has an upstream end in a direction of toner conveyance, and a downstream end in the direction of toner conveyance that is positioned higher than said upstream end;

a rotatable toner stirring member disposed in said container in juxtaposition with said toner conveying member; and a wall member disposed in said container adjacent said toner conveying member and disposed between said toner conveying member and said toner stirring member, said wall member dividing the interior of said container into a first section in which said toner conveying member is disposed and a second section in which said toner stirring member is disposed, wherein said first section has an upper portion that is open to said second section such that toner within said container is movable from said second section into said first section; and support means for supporting said container such that said container is pivotable on a substantially horizontal plane about an axis passing through the first longitudinal end portion of said container, wherein said container pivots between a first position, where the container is disposed inside a body of said apparatus, and a second position, where the container is disposed substantially outside said body, and wherein said container is arranged for receiving therein a toner supplement through said toner inlet opening when said container is disposed in said second position.

10. An apparatus according to claim 9, wherein said toner conveying member is a screw.

11. An apparatus according to claim 10, wherein the axis of rotation of said toner conveying member is substantially parallel with said inclined bottom surface of said container, and wherein said inclined bottom surface is inclined at an angle in the range of 5 to 20 degrees with respect to a horizontal reference plane.

12. An apparatus according to claim 9, wherein said toner stirring member has a locus of rotation having a radius that is greater than a radius of a locus of rotation of said toner conveying member, and wherein said wall member has an upper edge that is lower than the highest point of the locus of rotation of said toner stirring member.

13. An apparatus according to claim 10, wherein said toner stirring member has a locus of rotation having a radius that is greater than a radius of a locus of rotation of said toner conveying member, and wherein said wall member has an upper edge that is lower than the highest point of the locus of rotation of said toner stirring member.

14. An apparatus according to claim 11, wherein said toner stirring member has a locus of rotation having a radius that is greater than a radius of a locus of rotation of said toner conveying member, and wherein said wall member has an upper edge that is lower than the highest point of the locus of rotation of said toner stirring member.

15. An apparatus according to claim 12, wherein the upper edge of said wall member is positioned as high as or higher than the highest point of a locus of rotation of said toner conveying member.

16. An apparatus according to claim 13, wherein the upper edge of said wall member is positioned as high as or higher than the highest point of a locus of rotation of said toner conveying member.

17. An apparatus according to claim 14, wherein the upper edge of said wall member is positioned as high as or higher than the highest point of a locus of rotation of said toner conveying member.

* * * * *

UNITED STATES PATENT AND TRADEMARK OFFICE

CERTIFICATE OF CORRECTION

PATENT NO. : 5,331,381

DATED : July 19, 1994

INVENTOR(S) : OTA ET AL.

It is certified that error appears in the above-indentified patent and that said Letters Patent is hereby corrected as shown below:

COLUMN 3

Line 60, "1ain-" should read --1a in- --.

COLUMN 9

Line 24, "claim 2," should read --claim 1,--.

Signed and Sealed this

Fifteenth Day of November, 1994

Bruce Lehman

*Attest:*

BRUCE LEHMAN

*Attesting Officer*

*Commissioner of Patents and Trademarks*